US006889019B2

(12) United States Patent
Shin

(10) Patent No.: US 6,889,019 B2
(45) Date of Patent: May 3, 2005

(54) CARRIER VAPOR DILUTING UNIT OF A LIQUID PRINTER AND LIQUID PRINTER EMPLOYING THE SAME

(75) Inventor: Hyun-seong Shin, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 2 days.

(21) Appl. No.: 10/453,887

(22) Filed: Jun. 4, 2003

(65) Prior Publication Data

US 2004/0037582 A1 Feb. 26, 2004

(30) Foreign Application Priority Data

Aug. 22, 2002 (KR) ..... 10-2002-0049701

(51) Int. Cl.[7] ..... G03G 21/20
(52) U.S. Cl. ..... 399/93; 399/122
(58) Field of Search ..... 399/91, 92, 93, 399/98, 122, 96, 237, 250, 251

(56) References Cited

U.S. PATENT DOCUMENTS 5,708,938 A * 1/1998 Takeuchi et al. ..... 399/250
6,418,288 B2 * 7/2002 Saitoh ..... 399/250

FOREIGN PATENT DOCUMENTS

JP 60-104978 6/1985

OTHER PUBLICATIONS

Indoor Environmental Quality (IEQ); State of Minnesota Guidelines for Managing Indoor Air Quality; May 1995; Building Air Quality Manual; pp. 1–20.

* cited by examiner

*Primary Examiner*—Hoan Tran
(74) *Attorney, Agent, or Firm*—Staas & Halsey LLP

(57) ABSTRACT

A carrier vapor diluting unit of a liquid printer dilutes and exhausts carrier vapor generated in a fusing apparatus. The unit includes a housing to surround the thermal roller and the pressing roller, a duct which is connected to an inside and an outside of the housing and forms a path through which a mixed gas in which the carrier vapor is mixed with the air is drawn and exhausted, and a fan which forcibly transfers the mixed gas via the duct.

27 Claims, 4 Drawing Sheets

CARRIER VAPOR DILUTING UNIT OF A LIQUID PRINTER AND LIQUID PRINTER EMPLOYING THE SAME

CROSS-REFERENCE TO RELATED APPLICATIONS

This application claims the benefit of Korean Application No. 2002-49701, filed Aug. 22, 2002, in the Korean Intellectual Property Office, the disclosure of which is incorporated herein by reference.

BACKGROUND OF THE INVENTION

1. Field of the Invention

The present invention relates to liquid printers, and more particularly, to a liquid printer having a carrier vapor diluting unit which dilutes and exhausts carrier vapor generated in a fusing apparatus to fuse an image on paper using heat and pressure.

2. Description of the Related Art

In general, liquid printers form a toner image by supplying a developing agent in which toner particles are distributed to a liquid carrier, to an electrostatic latent image formed on a photosensitive body and transfer the toner image onto paper, fuse the toner image on the paper and form an image.

FIG. 1 schematically shows a conventional liquid printer using a low-concentration developing agent having a toner concentration of 2.5–3% solid. Referring to FIG. 1, the conventional liquid printer includes a photosensitive belt 20 charged to a predetermined voltage by a charger 10, a light scanning unit 40 which forms an electrostatic latent image of a desired image by irradiating light on the charged photosensitive belt 20 and forming a relative potential difference between a portion on which light is irradiated and a portion on which light is not irradiated, a developing unit 30 which forms a toner image on the photosensitive belt 20 by supplying a developing agent to the electrostatic latent image, a transfer roller 60 which transfers the toner image developed on the photosensitive belt 20 onto paper S, and a fusing roller 70 which fuses the toner image on the paper S using heat and pressure.

In a liquid printer, ink having high concentration of about 12% solid is withdrawn from an ink reservoir 34, and ink is mixed and diluted by a mixer 35 with a liquid carrier supplied from a carrier reservoir 37, and ink is formed as a low-concentration developing agent having toner concentration of 2.5–3% solid and is then supplied to a developing container 33 using a pump 36.

To develop an electrostatic latent image using a low-concentration of the developing agent, sufficient toner should be supplied to the electrostatic latent image. Thus, in the liquid printer shown in FIG. 1, a sufficient developing agent is spread between the photosensitive belt 20 and a developing roller 31, and an excessively-spread developing agent is removed using a squeeze roller 32.

Before the toner image formed on the photosensitive belt 20 is transferred onto the transfer roller 60, a drying process to remove a liquid carrier attached to the photosensitive belt 20 liquid carrier for the toner is performed. For this purpose, a drier 50 is installed between the developing unit 30 and the transfer roller 60. The drier 50 evaporates the liquid carrier by spreading the high-temperature air on the photosensitive belt 20 and transfers a mixed gas in which carrier vapor is mixed with the air, to a condenser 80. After the drying process is performed, the toner image formed on the photosensitive belt 20 is transferred to the transfer roller 60.

A fusing roller 70 is engaged with the transfer roller 60 and rotates, and the paper S is transferred between the fusing roller 70 and the transfer roller 60. Then, the toner image is transferred onto the paper S and is fused on the paper S due to the heat and pressure generated in the transfer roller 60 and the fusing roller 70. A transfer roller cleaning unit 61 is provided in the transfer roller 60. The transfer roller cleaning unit 61 evaporates the liquid carrier remaining in the transfer roller 60 and transfers the mixed gas in which the carrier vapor is mixed with the air, to the condenser 80.

The condenser 80 withdraws the liquid carrier by condensing the mixed gas transferred by the drier 50 and the transfer roller cleaning unit 61. The mixed gas passes through the condenser 80, and the liquid carrier is filtered again while passing through the filter 90, and is exhausted to the air.

Likewise, the liquid printer using a low-concentration developing agent includes a plurality of heat sources such as the drier 50, the transfer roller cleaning unit 61, and the fusing roller 70, and thus, a large amount of carrier vapor is generated in the liquid printer. Thus, in order to withdraw carrier vapor, the condenser 80, the filter 90, and pipes 81 and 82 to connect the condenser 80 to the filter 90, and a fan (not shown) to transfer the mixed gas forcibly to the condenser 80 are provided.

However, a liquid printer which may be used without diluting a high-concentration developing agent having a toner concentration over 3% solid has been recently suggested. A process to dilute high-concentration ink is not needed in the liquid printer. Thus, the liquid printer does not require the mixer 35, the pump 36, and the squeeze roller 32, and has a simplified and compact structure. In addition, since a heat source is not used, excluding in a process for fusing the toner image on the paper S using heat, the amount of carrier vapor is smaller than the amount of carrier vapor in a liquid printer using a low-concentration developing agent. Thus, a method to mix carrier vapor with the air and dilute and exhaust the carrier vapor, rather than withdraw the carrier vapor using a complicated apparatus such as the condenser 80 of FIG. 1, is required.

SUMMARY OF THE INVENTION

The present invention provides a carrier vapor diluting unit for a liquid printer which dilutes and exhausts carrier vapor generated in a process to fuse a toner image on a paper of a liquid printer using a high-concentration developing agent and a liquid printer employing the same.

According to an aspect of the present invention, a carrier vapor diluting unit of a liquid printer dilutes and exhausts carrier vapor generated in a fusing apparatus to fuse an image on a paper using heat and pressure, while passing the paper between a thermal roller and a pressing roller that are engaged with each other and rotate. The unit includes a housing to surround the thermal roller and the pressing roller; a duct which is connected to an inside and outside of the housing and forms a path through which a mixed gas in which the carrier vapor is mixed with the air is drawn into and exhausted; and a fan which forcibly transfers the mixed gas via the duct.

According to another aspect of the present invention, a liquid printer comprises a photosensitive drum on which an electrostatic latent image is formed, a developing unit including a developing roller which forms a toner image by supplying a liquid developing agent to the electrostatic latent image, a transfer medium which transfers the toner image onto the paper, and a fusing unit which fuses the toner image on the paper using heat and pressure, while passing the paper between a thermal roller and a pressing roller that are engaged with each other and rotate, and a carrier vapor diluting unit which dilutes and exhausts carrier vapor generated in the fusing apparatus. The carrier vapor diluting unit includes a housing to surround the thermal roller and the pressing roller; a duct which is connected to an inside and an outside of the housing and forms a path through which a mixed gas in which the carrier vapor is mixed with the air is drawn into and exhausted; and a fan which forcibly transfers the mixed gas via the duct.

The duct may comprise a first duct region into which the mixed gas is drawn; and a second duct region which communicates with the first duct region and includes an expansion part, of which a sectional area gradually increases in a flow direction of the mixed gas and an exhaust hole through which the mixed gas is exhausted.

Additional aspects and advantages of the invention will be set forth in part in the description which follows and, in part, will be obvious from the description, or may be learned by practice of the invention.

The first duct region is generally installed in an image side of the paper to be adjacent to a fusing nip in which the thermal roller and the pressing roller are engaged with each other, and the first duct region is installed in outlets of the thermal roller and the pressing roller.

The fan is generally installed between the first duct region and the second duct region.

An absorption element which absorbs the carrier vapor may be installed inside the second duct region.

DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
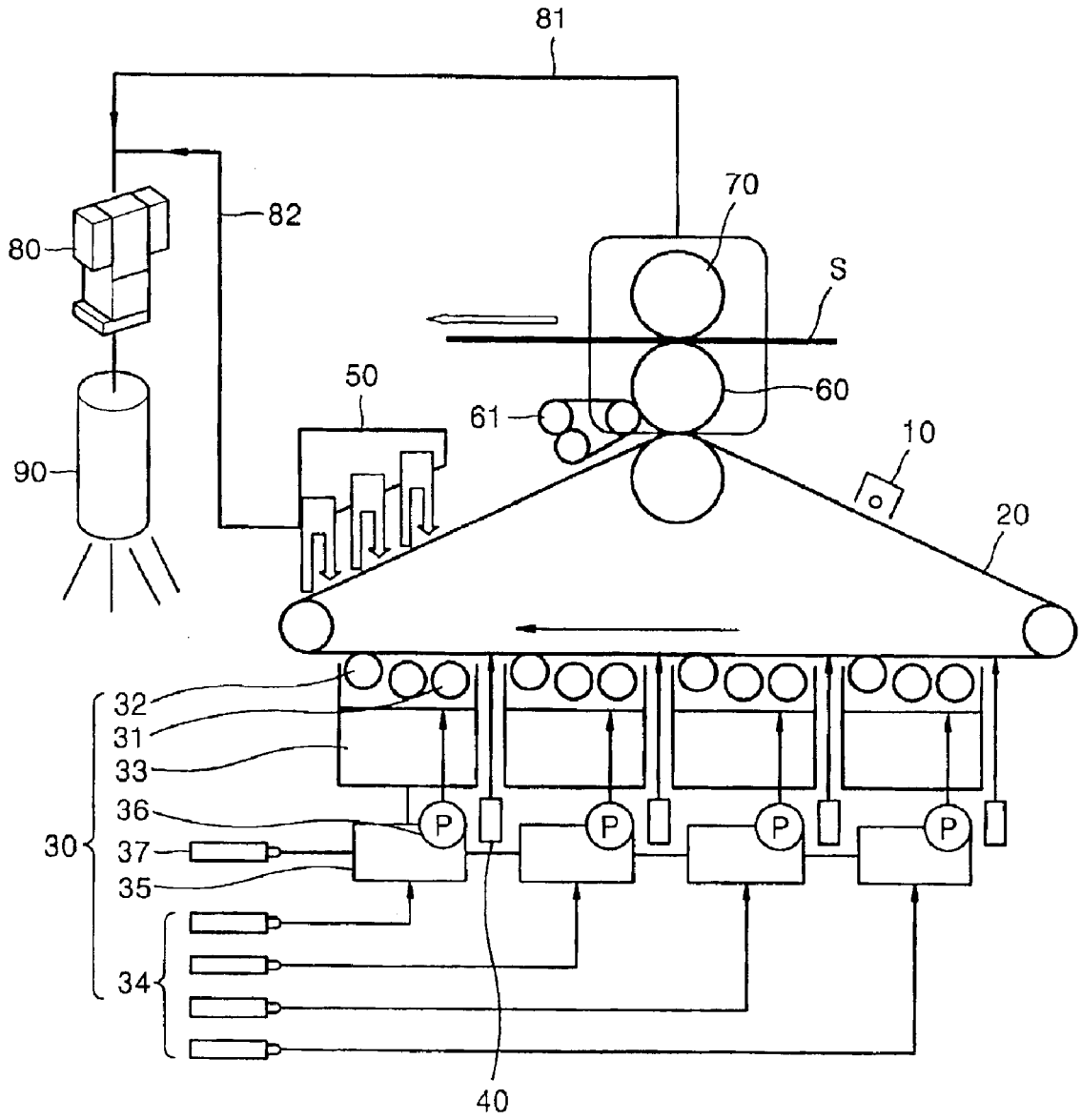
FIG. 1 (PRIOR ART)
FIG. 1 schematically shows a conventional liquid printer using a low-concentration developing agent.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, an embodiment of the present invention is described in detail with reference to the accompanying drawings.

Figure 2:
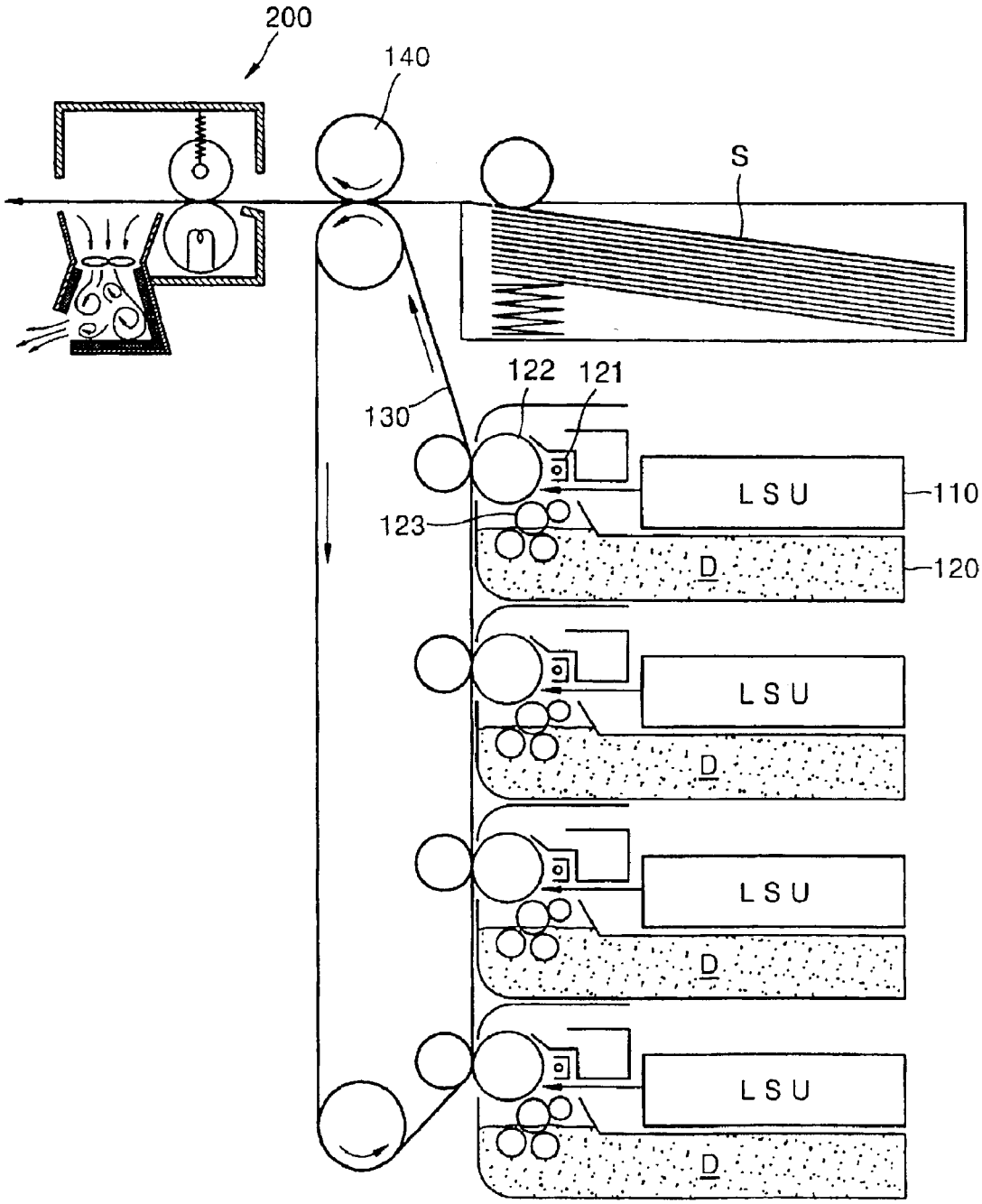
FIG. 2 schematically shows an embodiment of a liquid printer according to the present invention.
Figure 3:
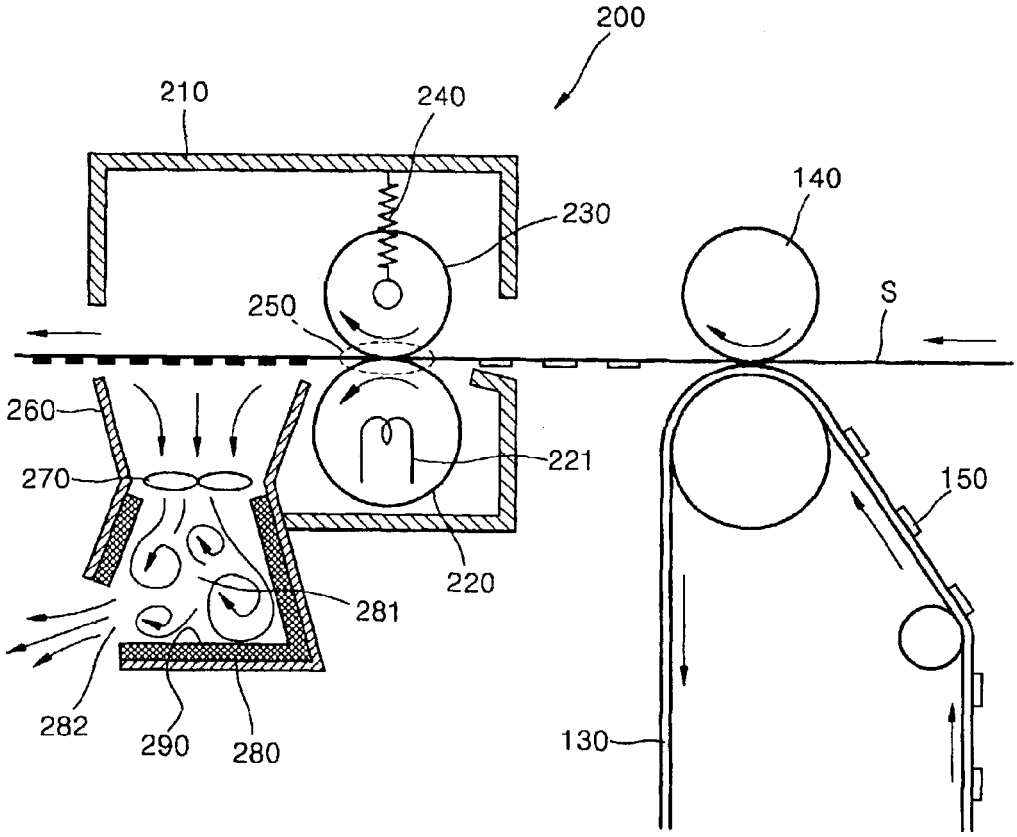
FIG. 3 specifically shows a carrier vapor diluting unit of FIG. 2, according to the present invention.

FIG. 2 schematically shows an embodiment of a liquid printer according to the present invention, and FIG. 3 specifically shows a carrier vapor diluting unit of FIG. 2, according to the present invention.

Referring to FIG. 2, the liquid printer according to the present invention includes a laser scanning unit (LSU) 110, a developing unit 120, a transfer belt 130, a transfer roller 140, and a fusing apparatus 200.

The laser scanning unit (LSU) 110 forms an electrostatic latent image of a desired image by irradiating laser corresponding to image information on a photosensitive drum 122 in which a surface potential is uniformly formed by the charger 121 and forming a relative potential difference between a portion on which the laser is irradiated and a portion on which the laser is not irradiated.

A high-concentration developing agent D is held in the developing unit 120, and a developing roller 123 which supplies the developing agent D to the photosensitive drum 122 is provided. The developing unit 120 is placed so that the photosensitive drum 122 contacts the transfer belt 130.

The transfer belt 130 is supported by a plurality of rollers and circulated.

While paper S is transferred between the transfer roller 140 and the transfer belt 130, the transfer roller 140 transfers a toner image 150 (see FIG. 3) attached to the transfer belt 130 onto the paper S.

Toner particles are distributed to a liquid carrier, thus forming a developing agent D. The liquid carrier is a carbon compound such as NORPAR-12 or NORPAR-15. The developing agent D used in the liquid printer according to the present invention is a high-concentration developing agent having a toner concentration over 3% solid, preferably, 20–25% solid.

When the electrostatic latent image corresponding to image information is formed by the LSU 110 on the photosensitive drum 122, the developing roller 123, of which part is dipped in the developing agent inside the developing unit 120, supplies the developing agent D to the electrostatic latent image and forms a toner image. In this case, only toner may be attached to the electrostatic latent image, but in most cases, toner is attached to the electrostatic latent image together with the liquid carrier. The liquid carrier is transferred by the transfer roller 140 via the transfer belt 130 onto the paper S together with the toner image. The paper S to which the toner image and the liquid carrier are attached is transferred into a fusing apparatus 200.

Referring to FIG. 3, a thermal roller 220 and a pressing roller 230 which are engaged with each other and rotate, are installed in a housing 210.

The thermal roller 220 is a metallic pipe having a cavity shape and applies heat to the liquid carrier together with a toner image attached to the paper S. For this purpose, a heat source 221 is installed in the thermal roller 220. A silicon rubber roller containing oil is used as the pressing roller 230, and the pressing roller 230 is pressed by a spring 240 toward the thermal roller 220. Oil forms an oil layer on the surface of the thermal roller 220 and the pressing roller 230 such that the paper S or toner is not attached to the thermal roller 220 or pressing roller 230 in a fusing process.

The pressing roller 230 and the thermal roller 220 may be spaced apart from each other by a predetermined gap in a printing standby state, and may be closely adhered to each other when a printing operation starts. Also, the transfer roller 140 may be spaced apart from the transfer belt 130 by a predetermined gap in the printing standby state. The transfer roller 140 may be closely adhered to the transfer belt 130 when the printing operation starts. When the pressing roller 230 contacts the thermal roller 220, a portion of the pressing roller 230 that contacts the thermal roller 220 is slightly deformed due to the pressure of the spring 240 so that the contact between the pressing roller 230 and the thermal roller 220 changes from a tangential contact to a sliding contact along contiguous sides of the two rollers. The contact portion is referred to as a fusing nip 250. Thermal transfer to the toner image attached to the paper S passing between the thermal roller 220 and the pressing roller 230 is mainly performed in the fusing nip 250. In the thermal transfer process, the carrier attached to the paper S is evaporated, thus resulting in carrier vapor.

The toner image attached to the paper S is fused on the paper S due to the heat and pressure. Thus, generally, when the paper S is fed into the fusing apparatus 200, the image side of the paper S, i.e., a side to which the toner image is attached, faces the thermal roller 220.

A first duct region 260, a second duct region 280 which communicates with the first duct region 260, and a fan 270, which exhausts a mixed gas in which the carrier vapor is mixed with the air via the first duct region 260 and the second duct region 280, are installed in outlets of the thermal roller 220 and the pressing roller 230. The first duct region 260 and the second duct region 280 form a path through which the mixed gas, in which the carrier vapor generated in a fusing step is mixed with the air, is drawn into and exhausted.

The first duct region 260 extends in a widthwise direction of the fusing apparatus 200 and is a path through which the mixed gas is drawn. Generally, the first duct region 260 is installed as close to the fusing nip 250 as possible. To increase the effectiveness of gas removal, the first duct region 260 is installed on the image side of the paper S.

The second duct region 280 communicates with the first duct region 260 and includes an expansion part 281, of which a sectional area gradually increases in a flow direction of the mixed gas. An exhaust hole 282, which communicates with the outside of the housing 210, is formed at one side of the expansion part 281. An absorption element 290, which absorbs the carrier vapor, may be installed inside the second duct region 280, as shown in FIG. 3.

The fan 270 may be installed in a proper location inside the first duct region 260 and the second duct region 280. However, generally, the fan 270 is installed in a portion in which the first duct region 260 is connected to the second duct region 280, as is shown in FIG. 3.

The toner image and the liquid carrier are attached to the paper S fed into the fusing apparatus 200, as described above. When the paper S passes between the thermal roller 220 and the pressing roller 230, the toner is melted due to the heat and pressure and is fixed on the paper S, thus forming an image. Typically, the liquid carrier is evaporated due to the heat, and is in a vaporized state. The carrier vapor is drawn by the fan 270 into the first duct region 260 in a mixed gas state, in which the carrier vapor is mixed with the air.

Since thermal transfer using the thermal roller 220 is mainly performed in the fusing nip 250, the carrier vapor is mainly generated in the fusing nip 250, and thus is exhausted to outlets of the thermal roller 220 and the pressing roller 230. Also, the liquid carrier is mainly attached to the image side of the paper S, and thus, the carrier vapor is generated toward the image side of the paper S. As is shown in FIG. 3, the first duct region 260 is installed in the outlets of the thermal roller 220 and the pressing roller 230 to be adjacent to the fusing nip 250, i.e., on the image side of the paper S. Thus, the carrier vapor can be drawn into the first duct region 260 effectively.

The mixed gas drawn into the first duct region 260 is transferred by the fan 270 to the second duct region 280. Since a sectional area of the expansion part 281 of the second duct region 280 gradually increases in a flow direction of the mixed gas, the mixed gas is expanded while passing the expansion part 281, and thus, a volume of the expansion part 281 increases. However, since the amount of the carrier vapor is constant, the concentration of the carrier vapor in the mixed gas is reduced. Also, due to the absorption element 290 installed in an inner wall of the expansion part 281, the expanded mixed gas contacts the absorption element 290, and the carrier vapor is absorbed to the absorption element 290. Thus, the concentration of the carrier vapor in the mixed gas is further reduced.

Figure 4:
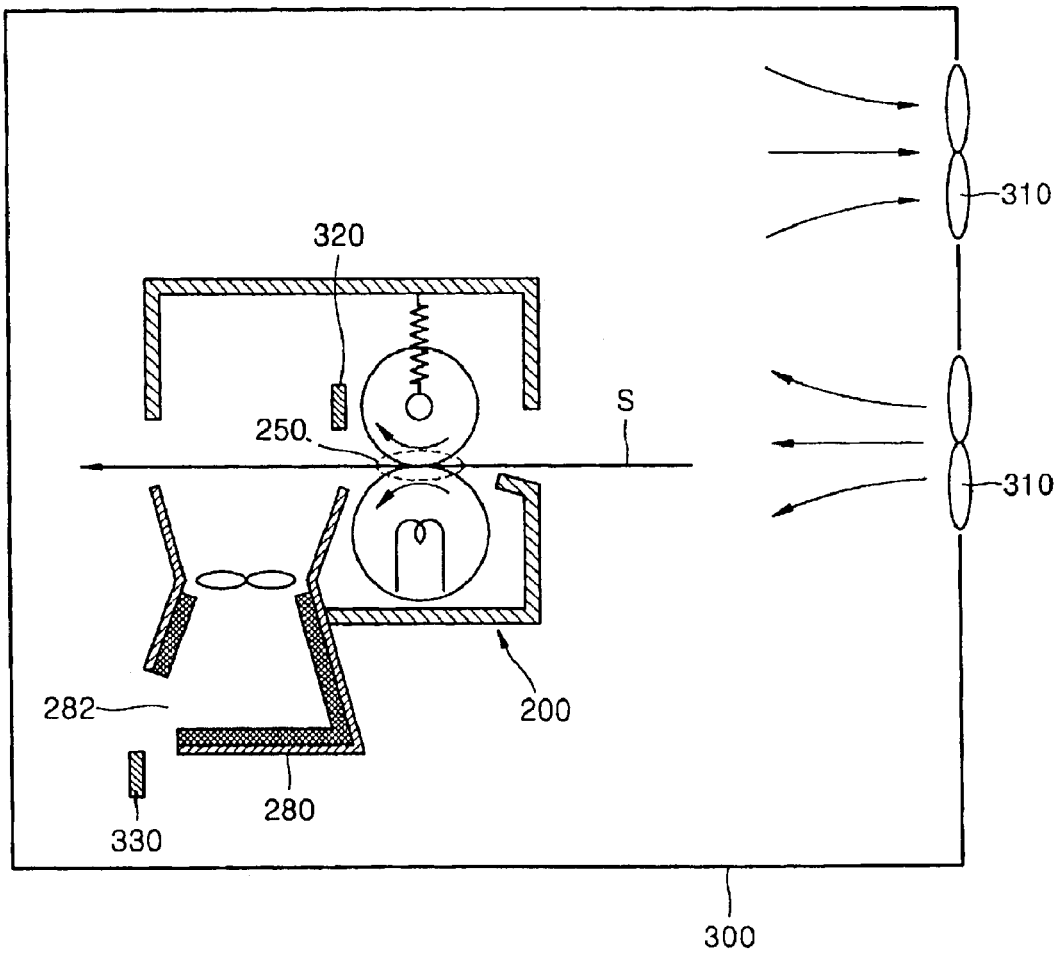
FIG. 4 illustrates a tester to test a carrier vapor diluting effect of the carrier vapor diluting unit of FIG. 3, according to the present invention.

FIG. 4 illustrates a tester to test a carrier vapor diluting effect of the carrier vapor diluting unit of FIG. 3, according to the present invention.

The fusing apparatus 200 is installed in a test chamber 300 having a volume of about 3.5 cubic meter, and a fusing temperature is about 100° C., and the fusing apparatus 200 operates at a fusing speed of 15 A4 sheets per minute for about five minutes. A fan 310 draws air in and exhausts the air at the speed of about 15 cubic feet per minute (cfm). A first sensor 320 is installed near the fusing nip 250 in which the carrier vapor is generated, and a second sensor 330 is installed in the exhaust hole 282 of the second duct region 280, to measure the concentration of the carrier vapor.

A carbon compound such as NORPAR-12 and NORPAR-15 is used as the liquid carrier. NORPAR-12 is easily evaporated but is not well condensed, and NORPAR-15 is easily condensed but is not well evaporated.

When NORPAR-12 is used as the liquid carrier, carrier vapor of about 1183 ppm is detected by the first sensor 320, and when the fan 310 does not operate, carrier vapor of about 108.4 ppm is detected by the second sensor 330, and when the fan 310 operates, carrier vapor of about 30 ppm is detected by the second sensor 330. Also, when NORPAR-15 is used as the liquid carrier, carrier vapor of about 50.7 ppm is detected by the first sensor 320. When the fan 310 does not operate, carrier vapor of about 10 ppm is detected by the second sensor 330, and when the fan 310 operates, carrier vapor of about 0.7 ppm is detected by the second sensor 330.

It is known from the results of testing that when the fan 310 is used, the concentration of the carrier vapor is rapidly reduced, and the concentration of the carrier vapor at a place spaced apart 30 centimeters from the fusing nip 250, in which the carrier vapor is generated, is less than 140 ppm, thus satisfying conditions stipulated in the Minnesota Occupational Safety and Health Act (MOSHA) rules 5205.0110. The absorption element 290 is not used in this test. Thus, if the absorption element 290 is used, the concentration of the carrier vapor may be reduced further.

As described above, in a carrier vapor diluting unit of a liquid printer and a liquid printer employing the same according to the present invention, a mixed gas containing carrier vapor is expanded such that the concentration of the carrier vapor is reduced, and when an absorption element is used, the concentration of the carrier vapor may be further reduced. Also, a carrier vapor diluting unit may be formed as a single body with the fusing apparatus such that the liquid printer may be miniaturized. Also, an additional condenser and a filter are not required, and thus, costs may be reduced.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A carrier vapor diluting unit of a liquid printer, which dilutes and exhausts carrier vapor generated in a fusing apparatus to fuse an image on paper using heat and pressure while passing the paper between a thermal roller and a pressing roller that are engaged and rotate, the unit comprising:

a housing to surround the thermal roller and the pressing roller;

a duct which is connected to an inside and an outside of the housing and forms a path through which a mixed gas in which the carrier vapor is mixed with the air is drawn into and exhausted; and a fan which forcibly transfers the mixed gas via the duct.

2. The unit of claim 1, wherein the duct comprises:

a first duct region into which the mixed gas is drawn; and a second duct which communicates with region coupled to the first duct region, which includes an expansion part of which a sectional area gradually increases in a flow direction of the mixed gas and an exhaust hole through which the mixed gas is exhausted.

3. The unit of claim 2, wherein the first duct region is installed on an image side of the paper adjacent to a fusing nip in which the thermal roller and the pressing roller are engaged.

4. The unit of claim 2, wherein the first duct region is installed in outlets of the thermal roller and the pressing roller.

5. The unit of claim 2, wherein the fan is installed between the first duct region and the second duct region.

6. The unit of claim 2, wherein an absorption element which absorbs the carrier vapor is installed inside the second duct region.

7. A liquid printer comprising:

a photosensitive drum on which an electrostatic latent image is formed;

a developing unit including a developing roller which forms a toner image by supplying a liquid developing agent to the electrostatic latent image;

a transfer medium which transfers the toner image onto the paper;

a fusing apparatus which fuses the toner image on the paper using heat and pressure while passing the paper between a thermal roller and a pressing roller that are engaged with each other and rotate; and a carrier vapor diluting unit which dilutes and exhausts carrier vapor generated in the fusing apparatus, wherein the carrier vapor diluting unit comprises:

a housing to surround the thermal roller and the pressing roller;

a duct which is connected to an inside and an outside of the housing and forms a path through which a mixed gas in which the carrier vapor is mixed with the air is drawn and exhausted; and a fan which forcibly transfers the mixed gas via the duct.

8. The printer of claim 7, wherein the duct comprises:

a first duct region into which the mixed gas is drawn; and a second duct region coupled to the first duct region, which includes an expansion part of which a sectional area gradually increases in a flow direction of the mixed gas and an exhaust hole through which the mixed gas is exhausted.

9. The printer of claim 8, wherein the first duct region is installed in an image side of the paper adjacent to a fusing nip in which the thermal roller and the pressing roller are engaged with each other.

10. The printer of claim 8, wherein the first duct region is installed in outlets of the thermal roller and the pressing roller.

11. The printer of claim 8, wherein the fan is installed between the first duct region and the second duct region.

12. The printer of claim 8, wherein an absorption element which absorbs the carrier vapor is installed inside the second duct region.

13. A fusing apparatus housing of a liquid printer, which dilutes and exhausts a carrier vapor generated in a fusing apparatus that fuses an image on paper using heat and pressure, the fusing apparatus housing comprising:

a ducted housing, surrounding the fusing apparatus, having at least one duct extending from an inside to an outside of the ducted housing and through which a mixed gas is exhausted, the mixed gas comprising the carrier vapor mixed with air.

14. The fusing apparatus housing of claim 13, further including a fan which forcibly transfers the mixed gas via the at least one duct.

15. The fusing apparatus housing of claim 14, wherein the at least one duct comprises:

a first duct region into which the mixed gas is drawn; and a second duct region coupled to the first duct region, which includes an expansion part of which a sectional area gradually increases in a flow direction of the mixed gas and an exhaust hole through which the mixed gas is exhausted.

16. The fusing apparatus housing of claim 15, wherein the first duct region is installed on an image side of the paper adjacent to a fusing nip.

17. The fusing apparatus housing of claim 15, wherein the first duct region is installed in outlets of a thermal roller and a pressing roller of the fusing apparatus.

18. The fusing apparatus housing of claim 15, wherein the fan is installed between the first duct region and the second duct region.

19. The fusing apparatus housing of claim 15, wherein an absorption element which absorbs the carrier vapor is installed inside the second duct region.

20. A liquid printer comprising:

a photosensitive drum on which an electrostatic latent image is formed;

a developing unit including a developing roller which forms a toner image by supplying a liquid developing agent to the electrostatic latent image;

a transfer medium which transfers the toner image onto the paper; and a fusing apparatus which fuses the toner image on the paper using heat and pressure while passing the paper between a thermal roller and a pressing roller that are engaged with each other and rotate;

wherein the fusing apparatus comprises a fusing apparatus housing which dilutes and exhausts a carrier vapor generated in the fusing apparatus, the fusing apparatus housing comprising:

a ducted housing, surrounding the fusing apparatus, having at least one duct extending from an inside to an outside of the ducted housing and through which a mixed gas is exhausted, the mixed gas comprising the carrier vapor mixed with air.

21. The liquid printer of claim 20, the ducted housing further including a fan which forcibly transfers the mixed gas via the at least one duct region.

22. The liquid printer of claim 21, wherein the at least one duct comprises:

a first duct region into which the mixed gas is drawn; and a second duct region coupled to the first duct region, which includes an expansion part of which a sectional area gradually increases in a flow direction of the mixed gas and an exhaust hole through which the mixed gas is exhausted.

23. The liquid printer of claim 22, wherein the first duct region is installed in an image side of the paper adjacent to a fusing nip in which the thermal roller and the pressing roller are engaged with each other.

24. The liquid printer of claim 22, wherein the first duct region is installed in outlets of the thermal roller and the pressing roller.

25. The liquid printer of claim 22, wherein the fan is installed between the first duct region and the second duct region.

26. The liquid printer of claim 22, wherein an absorption element which absorbs the carrier vapor is installed inside the second duct region.

27. A fusing apparatus that fuses an image on paper using heat and pressure, the fusing apparatus having a carrier vapor diluting unit formed as a single body with the fusing apparatus to dilute and exhaust a carrier vapor generated in the fusing apparatus, wherein the carrier vapor diluting unit has at least one duct extending from an inside to an outside of a housing of the fusing apparatus, through which a mixed gas is exhausted, the mixed gas comprising the carrier vapor mixed with air.

* * * * *

UNITED STATES PATENT AND TRADEMARK OFFICE

CERTIFICATE OF CORRECTION

PATENT NO. : 6,889,019 B2
DATED : May 3, 2005
INVENTOR(S) : Hyun-seoung Shin

It is certified that error appears in the above-identified patent and that said Letters Patent is hereby corrected as shown below:

Column 7,
Line 17, delete “which communicates with”.
Line 52, insert -- ¶ -- after “and”.

Signed and Sealed this

Third Day of January, 2006

JON W. DUDAS
*Director of the United States Patent and Trademark Office*